US009436153B2

(12) United States Patent
Yamashita

(10) Patent No.: US 9,436,153 B2
(45) Date of Patent: Sep. 6, 2016

(54) APPARATUS INCLUDING MOVABLY PROVIDED COVER

(71) Applicant: CANON KABUSHIKI KAISHA, Tokyo (JP)

(72) Inventor: Fuyuto Yamashita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/019,251

(22) Filed: Sep. 5, 2013

(65) Prior Publication Data

US 2014/0072333 A1 Mar. 13, 2014

(30) Foreign Application Priority Data

Sep. 7, 2012 (JP) ..... 2012-196871
Jun. 24, 2013 (JP) ..... 2013-131661

(51) Int. Cl.
*G03G 21/00* (2006.01)
*G03G 21/16* (2006.01)

(52) U.S. Cl.
CPC ..... *G03G 21/1623* (2013.01); *G03G 21/1633* (2013.01); *G03G 2215/0177* (2013.01)

(58) Field of Classification Search
CPC ..... G03G 21/1623; G03G 21/1633
USPC ..... 399/110, 111
See application file for complete search history.

(56) References Cited

U.S. PATENT DOCUMENTS 8,032,071 B2 * 10/2011 Andoh et al. ..... 399/405
2010/0247140 A1 * 9/2010 Kikuchi et al. ..... 399/111

FOREIGN PATENT DOCUMENTS

JP 4272860 B2 6/2009

* cited by examiner

*Primary Examiner* — Quana M Grainger
(74) *Attorney, Agent, or Firm* — Canon U.S.A. Inc., IP Division

(57) ABSTRACT

An apparatus includes a cover including a protrusion and provided to be movable, and an abutment unit provided to be capable of abutting the protrusion and including a second member for applying a force to a first member of an image forming apparatus. The abutment unit includes a first surface which abuts the protrusion in a case where the cover is shifted from an opened state to a closed state and a second surface which abuts the protrusion in a case where the cover is shifted to the closed state after having abutted the first surface, and the protrusion is applied a force from a rotational force of the abutment unit when the protrusion abuts the second surface, and the second member of the abutment unit applies a force to the first member when the cover is in the closed state.

19 Claims, 8 Drawing Sheets

APPARATUS INCLUDING MOVABLY PROVIDED COVER

BACKGROUND OF THE INVENTION

1. Field of the Invention

The present invention relates to an apparatus including a movably provided cover, in particular, an image forming apparatus including a movably provided cover, such as a copying machine, a laser beam printer, and a facsimile.

2. Description of the Related Art

Conventionally, an electrophotographic image forming apparatus that forms an image on a recording medium with use of an electrophotographic image forming process have been known as an image forming apparatus. In many cases, an electrophotographic image forming apparatus employs a process cartridge method in which an integrated cartridge including an electrophotographic photosensitive member, a charging unit, and other members for forming electrophotographic images is provided to be attachable to and detachable from a body of the electrophotographic image forming apparatus.

When an electrophotographic image forming apparatus employs the process cartridge method, a process cartridge and a body of the electrophotographic image forming apparatus exist as separate members. Thus, some electrophotographic image forming apparatuses include a storage medium provided to the process cartridge to enable more appropriate operation. This configuration necessitates providing the apparatus body with a mechanism for accessing the storage medium of the process cartridge (Japanese Patent No. 04272860).

However, the provision of the mechanism for accessing the storage medium of the process cartridge inside the body of the image forming apparatus as discussed in Japanese Patent No. 04272860 may lead to complication of the image forming apparatus and an increase in the number of parts.

SUMMARY OF THE INVENTION

The present invention is directed to suppressing an increase in the number of parts.

According to an aspect of the present invention, an apparatus includes a cover including a protrusion and provided to be movable, and an abutment unit provided to be capable of abutting the protrusion and including a second member for applying a force to a first member of an image forming apparatus. The abutment unit includes a first surface which abuts the protrusion in a case where the cover is shifted from an opened state to a closed state and a second surface which abuts the protrusion in a case where the cover is shifted to the closed state after having abutted the first surface, and the protrusion is applied a force from a rotational force of the abutment unit when the protrusion abuts the second surface, and the second member of the abutment unit applies a force to the first member when the cover is in the closed state.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

In the following description of exemplary embodiments of the present invention, a color laser beam printer, which is an image forming apparatus, is described. However, the present invention is also applicable to any common apparatus as well as image forming apparatuses including electrophotographic image forming apparatuses.

[1. Image Forming Apparatus]

Figure 1:
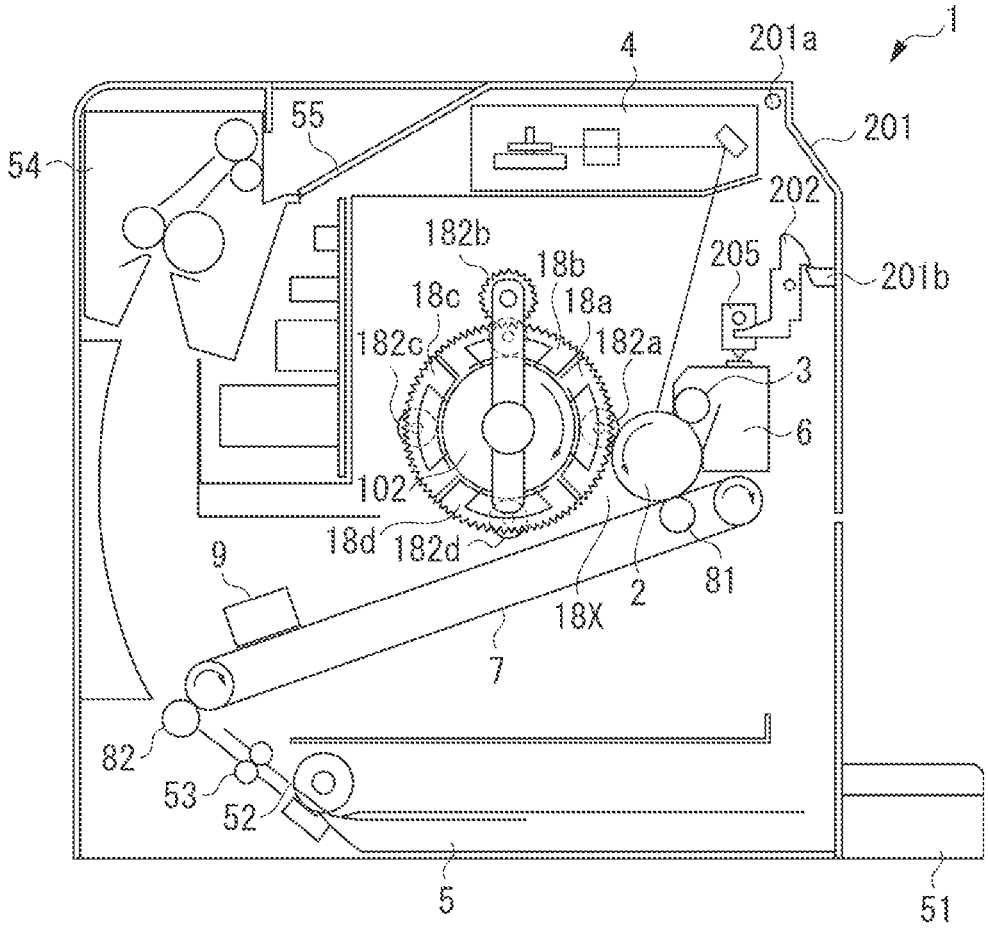
FIG. 1 is a cross sectional view illustrating a schematic configuration of a color laser beam printer as an example of an image forming apparatus.

An image forming apparatus according to an exemplary embodiment is described below. In the following description, a color laser beam printer including four developing devices is used as an example of the image forming apparatus. FIG. 1 is a cross sectional view of the color laser beam printer.

First, an image forming operation of the color laser beam printer will be described.

As illustrated in FIG. 1, an image forming apparatus 1 includes an electrophotographic photosensitive drum (hereinafter "photosensitive drum") 2 which is an image bearing member. A charging roller 3, an exposure device 4, four developing devices 18*a* to 18*d*, and a cleaning device 6 are disposed around the photosensitive drum 2. The charging roller 3 is a charging unit adapted to uniformly charge the photosensitive drum 2. The exposure device 4 is an exposure unit adapted to irradiate the photosensitive drum 2 with laser beams corresponding to image information. The charged photosensitive drum 2 is irradiated with the laser beams, so that an electrostatic latent image is formed on the photosensitive drum 2. Each of the developing devices 18*a* to 18*d* is a developing unit adapted to develop the electrostatic latent image formed on the photosensitive drum 2 with a developer of a corresponding color so that the electrostatic latent image is visualized.

The developing device 18*a* is a yellow developing device which stores a yellow developer to develop an electrostatic latent image with the yellow developer. The developing device 18*b* is a magenta developing device which stores a magenta developer to develop an electrostatic latent image with the magenta developer. The developing device 18*c* is a cyan developing device which stores a cyan developer to develop an electrostatic latent image with the cyan developer. The developing device 18*d* is a black developing device which stores a black developer to develop an electrostatic latent image with the black developer. In other words, the developing devices 18*a* to 18*d* develop an electrostatic latent image formed on the photosensitive drum 2.

The cleaning device 6 is a cleaning unit adapted to remove a residual developer remaining on a surface of the photosensitive drum 2.

The photosensitive drum 2 is rotated in a direction of an arrow indicated in FIG. 1 (rotated counterclockwise) in synchronization with a rotation of an intermediate transfer belt 7. The charging roller 3 uniformly charges the surface of the photosensitive drum 2. Then, the exposure device 4 irradiates the photosensitive drum 2 with light corresponding to a yellow image to form a yellow electrostatic latent image on the photosensitive drum 2.

Concurrently with the formation of the electrostatic latent image, a drive transmission mechanism rotates a rotary member 102. The rotary member 102 is a rotatable supporting member which rotates and supports the four developing devices 18*a* to 18*d* such that the developing devices 18*a* to 18*d* are attachable to and detachable from the rotary member 102. Then, the yellow developing device 18*a* is stopped at a development position 18X facing to the photosensitive drum 2. At the development position 18X, the photosensitive drum 2 is in contact with a developing roller 182*a* which is a developer bearing member included in the developing device 18*a*. A voltage with the same polarity as the charging polarity of the photosensitive drum 2 and substantially the same electric potential as the photosensitive drum 2 is applied to the developing roller 182*a* so that the yellow developer adheres to the electrostatic latent image on the photosensitive drum 2, so that the electrostatic latent image is developed with the yellow developer. More specifically, the rotary member 102 rotates while supporting the plurality of developing devices 18*a* to 18*d* to move the supported developing devices successively one after another to the development position 18X facing to the photosensitive drum 2. When positioned at the development position 18X, each of the developing devices 18*a* to 18*d* develops the electrostatic latent image based on the color of the developer stored therein. According to the present exemplary embodiment, an elastic roller in which a metal shaft is coated with rubber is used as the developing rollers 182*a* to 182*d* serving as the developer bearing members. According to the present exemplary embodiment, each of the developing rollers 182*a* to 182*d* is in contact with the photosensitive drum 2 at the development position 18X (contact development method). Each of the developing rollers 182*a* to 182*d* develops the electrostatic latent image while being in contact with the photosensitive drum 2. However, the present invention is not limited to the above-described configuration. The present invention is also applicable to a configuration in which at the development position 18X, each of the developing rollers 182*a* to 182*d* develops an electrostatic latent image while being in close proximity to but not in contact with the photosensitive drum 2. Then, a voltage with an opposite polarity to the polarity of the developer is applied to a primary transfer roller 81 disposed inside the transfer belt 7, so that the yellow developer image formed on the photosensitive drum 2 is primary transferred to the transfer belt 7.

The primary transfer of the yellow developer image is completed as described above. Then, the magenta, cyan, and black developing devices 18*b* to 18*d* are rotated and moved one after another by the rotating rotary member 102 and stopped at the development position 18X facing to the photosensitive drum 2. Then, as in the case of the yellow developer, the formation of an electrostatic latent image, development of the electrostatic latent image, and primary transfer of the developed image are successively performed for the respective magenta, cyan, and black developers. Accordingly, the developer images of the four colors overlap each other on the transfer belt 7.

During the above-described operations, a secondary transfer roller 82 is not in contact with the transfer belt 7. At that time, the cleaning unit 9 which removes residual toner remaining on the transfer belt 7 is not also in contact with the transfer belt 7.

A sheet S as a recording medium is stored in a cassette 51 provided at a lower portion of an apparatus body 90. A developer image is formed on a recording medium. Examples of a recording medium include a recording sheet, an overhead projector (OHP) sheet, and the like. The sheets S are separated by a feeding roller 52 one by one from the cassette 51 and fed to a pair of registration rollers (conveyance rollers) 53. The registration roller pair 53 sends the fed sheet S to an area between the transfer belt 7 and the transfer roller 82. The transfer roller 82 and the transfer belt 7 are in pressure contact with each other (a state illustrated in FIG. 1).

A voltage with the opposite polarity to the polarity of the developer is applied to the transfer roller 82, so that the developer images of the four colors overlapping with each other on the transfer belt 7 are collectively transferred (secondary transfer) onto a surface of the conveyed sheet S.

The sheet S on which the developer images have been transferred is sent to a fixing unit 54. The fixing unit 54 applies heat and pressure to the sheet S to fix the developer images onto the sheet S, so that a color image is formed on the sheet S. Then, the sheet S is discharged from the fixing unit 54 to a discharging unit of an upper cover 55 outside the apparatus body 90.

[2. Movably Provided Cover]

[State in which Cover is Opened (Opened State)]

The present exemplary embodiment is described in detail below with reference to FIGS. 2 to 6.

Figure 2:
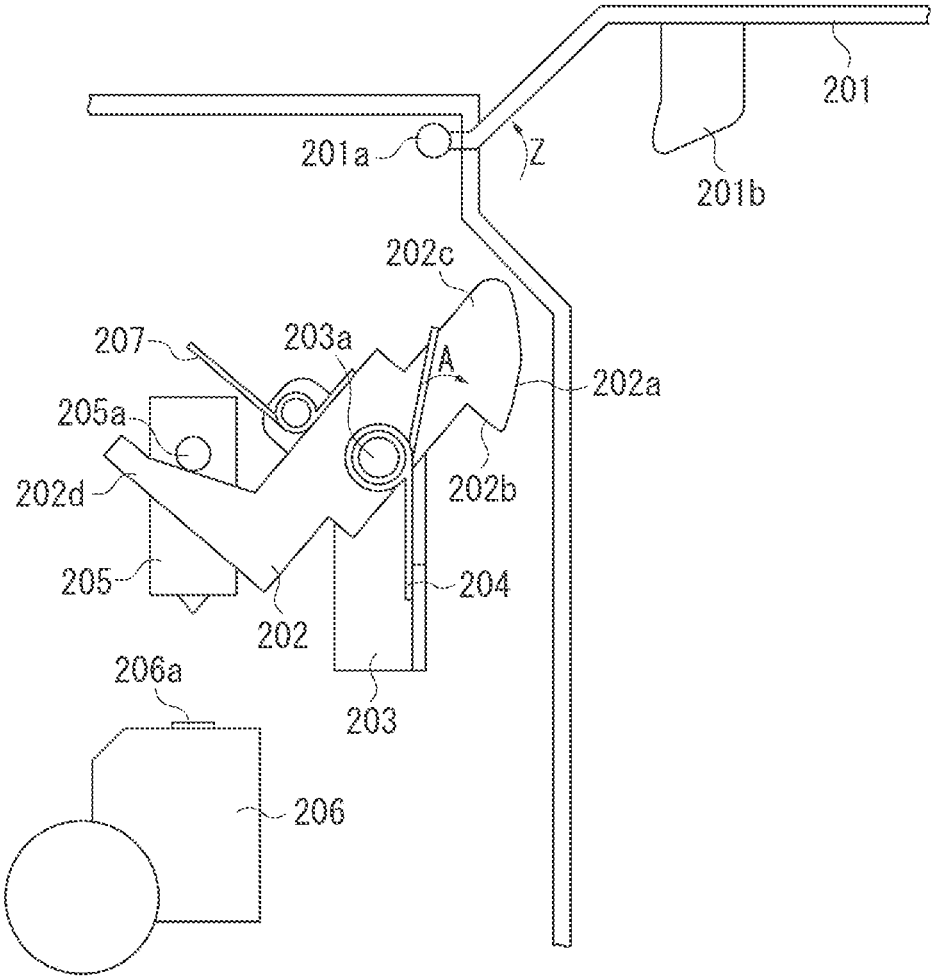
FIG. 2 is a schematic diagram illustrating an opened state of a cover.

FIG. 2 illustrates a state in which a cover 201 which is freely rotatably fixed to the apparatus body 90 is opened (i.e., an opened state). The cover 201 includes a rib (protrusion) 201*b* on an inner surface of the cover 201. When a process cartridge 206 is attached or detached, the cover 201 is opened and closed around a rotation fulcrum 201*a*. The cover 201 according to the present exemplary embodiment is not in a planar shape of a flat surface but in a convex shape protruding to the outside (the side opposite to the inside of the image forming apparatus where the photosensitive drum and other members are disposed) the rotation fulcrum 201*a*. When the cover 201 is opened in a direction Z, a storage medium access unit (first member) 205 for writing electric information to a storage medium 206*a* is released from contact with the storage medium 206*a* disposed on the process cartridge 206. More specifically, the storage medium access unit 205 is lifted by one end portion (lifting end portion) 202*d* of an arm (abutment unit) 202, so that the storage medium access unit 205 is released from the contact with the storage medium 206*a*. Therefore, the process cartridge 206 can be removed from the apparatus body 90. The present exemplary embodiment describes the example in which the storage medium is provided to the process cartridge including the image bearing member, however the storage medium may be provided to the developing device 18 including the developer bearing member or to the cleaning device 6. Alternatively, a storage medium such as a memory may be provided to each of the process cartridge 206, the developing device 18, and the cleaning device 6, and at least one of them may be brought into contact according to the exemplary embodiment of the present invention. In this case, the rest are brought into contact with use of a different means.

Operations of the storage medium access unit 205 that is performed when the cover 201 is opened is described. The arm 202 is attached to a base 203 fixed to the apparatus body 90 in a manner such that the arm 202 is freely rotatable about a rotation fulcrum 203*a*. The arm 202 is rotated clockwise by a moment A of a rocking torsion spring 204 so that the lifting end portion of the arm 202 lifts a boss 205*a* of the storage medium access unit 205 to separate the storage medium access unit 205 from the storage medium 206*a*.

The other end portion of the arm 202 on the opposite end of the lifting end portion is desirably in a shape of a sickle 202*c*. An external side of the sickle 202*c* is a first surface 202*a*, and an inner side of the sickle 202*c* is a second surface 202*b*. As to a relationship with the rib 201*b*, the arm 202 is provided so as to abut the rib 201*b*. The rib 201*b* frictionally slides on the first surface 202*a* while abutting the first surface 202*a*. After having frictionally slid on the first surface 202*a*, the rib 201*b* abuts the second surface 202*b*.

[State in which Cover is Shifted from Opened State to Closed State]

Figure 3:
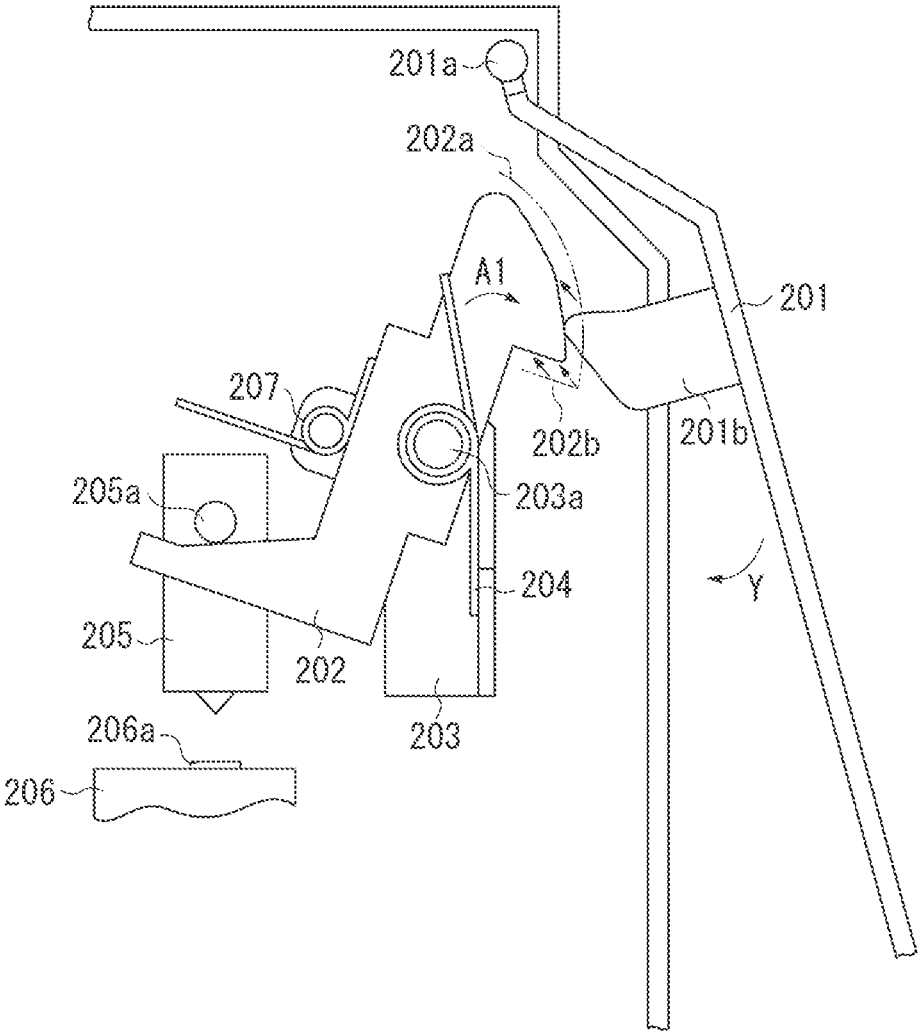
FIG. 3 is a schematic diagram illustrating a transition from an opened state to a closed state of a cover.
Figure 4:
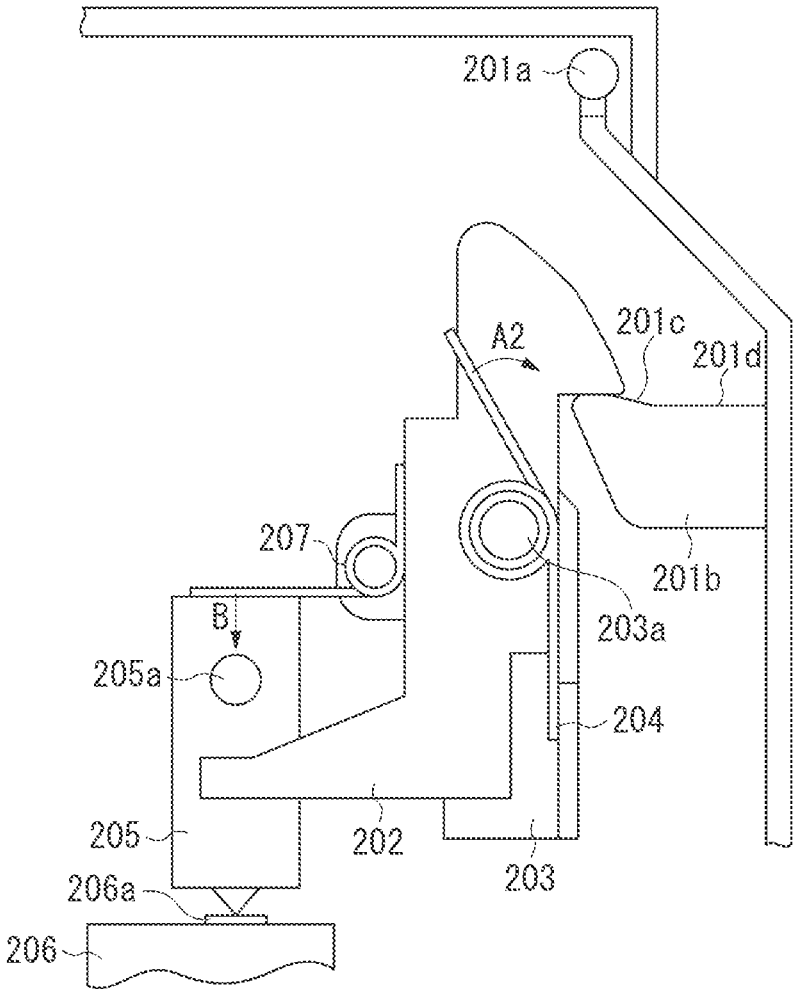
FIG. 4 is a schematic diagram illustrating a closed state of a cover.

FIG. 3 illustrates a state of the cover 201 which is freely rotatably fixed to the apparatus body 90 in transition from the opened state illustrated in FIG. 2 to a closed state illustrated in FIG. 4.

The rib 201*b* formed on the cover 201 rotates the arm 202 about the rotation fulcrum 203*a* of the base 203 fixed to the apparatus body 90 in the opposite direction to the moment A1. The rib 201*b* first abuts the first surface 202*a* of the arm 202. When the cover 201 is pushed further in a direction Y, which is the direction in which the cover 201 is closed from this state (after having abutted), the arm 202 is rotated in the opposite direction to the moment A1. As the cover 201 is pushed further in the direction Y, a contact point pushing torsion spring (second member) 207 attached to the arm 202 pushes the storage medium access unit (first member) 205 to bring the storage medium access unit 205 into contact with the storage medium 206*a*.

When the storage medium access unit 205 and the storage medium 206*a* are in contact with each other, not only the moment A1 of the rocking torsion spring 204 but also a reaction force of a force of the contact point pushing torsion spring (second member) 207 pushing the storage medium access unit (first member) 205 are applied to the arm 202. As the cover 201 is pushed further in the direction (direction Y) in which the cover 201 is closed, the arm 202 is further rotated and, consequently, an abutment surface where the rib 201*b* abuts the arm 202 is switched from the first surface 202*a* to the second surface 202*b*. The abutment surface is switched, so that a force is applied in the direction (direction Y) in which the cover 201 is automatically closed.

The end portion of the arm 202 that applies a force to the rib 201*b* of the cover 201 and the urging member (second member) 207 which stably applies a force to the storage medium access unit (first member) 205, are used integrally with the arm 202. With this configuration, there is no need to separately provide an urging unit (pushing unit) for stabilize a contact point of the storage medium 206*a* and the apparatus body 90. Thus, the number of parts can be reduced.

It is desirable to use a rib 201*b* including an intersecting surface 201*c* and a parallel surface 201*d* as illustrated in FIG. 4 so that a force is applied to the rib 201*b* to allow the cover 201 to be closed automatically with ease. The parallel surface 201*d* of the rib 201*b* is a surface parallel to the surface on which the apparatus is installed when the cover is in the closed state. The intersecting surface 201*c* of the rib 201*b* is a surface that intersects with the parallel surface 201*d*. It is desirable that the rib 201*b* is designed to include the intersecting surface 201*c* that intersects with the second surface 202*b* of the arm 202 while abutting the second surface 202*b* when the cover 201 is in the closed state. With the rib 201*b* designed as illustrated in FIG. 4 or 5, the intersecting surface 201*c* of the rib 201*b* and the second surface 202*b* of the arm 202 abut each other when the cover 201 is in the closed state, so that the rib 201*b* is urged by a rotational force from the arm 202 to allow the cover 201 to be closed automatically with ease.

If the intersecting surface 201*c* is not provided, the reaction force of the pushing force of the storage medium access unit 205 causes a force to be applied in the direction in which the cover 201 is opened. As a result, the point at which the cover 201 is closed may become unstable, which may lead to a deteriorated external view or unstable abutment force of the storage medium access unit 205.

Hence, the intersecting surface 201*c* is provided to improve an external view with reduced instability and lifting of an external cover, improve usability by automatic closing of the external cover, and stabilize the contact point pressure of the storage medium 206*a*.

Figure 5:
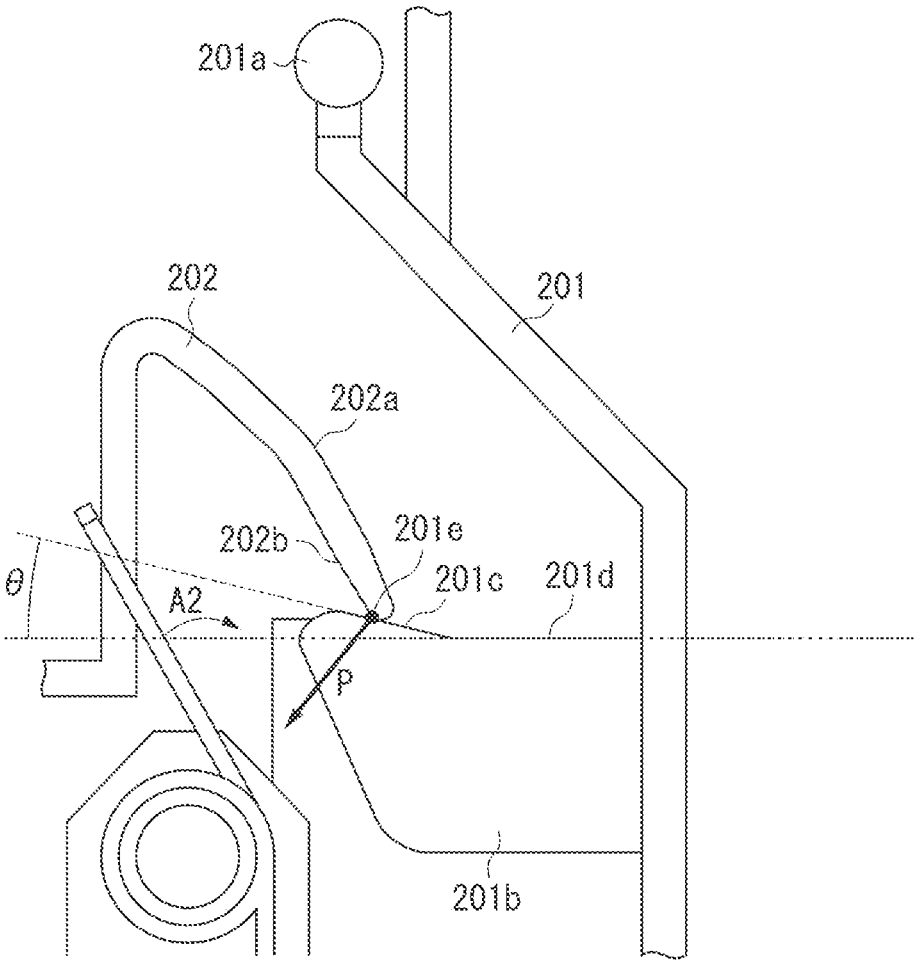
FIG. 5 is an enlarged view of an abutment portion of a rib and an arm.

As illustrated in FIG. 5, the surface of the rib 201*b* is inclined so as to convert a moment A2 transmitted by the arm 202 into a vector of a force P at an abutment portion 201*e* where the rib 201*b* and the arm 202 abut each other. The force P rotates the cover 201 about the rotation fulcrum 201*a* in the direction in which the cover 201 is closed. This allows the cover 201 to be closed automatically without requiring a user to completely push the cover 201.

Meanwhile, a reaction force of the force P is applied to the arm 202 in the direction in which the storage medium 206*a* is pushed further. This allows the storage medium access unit 205 to apply a force to the storage medium 206*a* more stably.

Figure 8A:
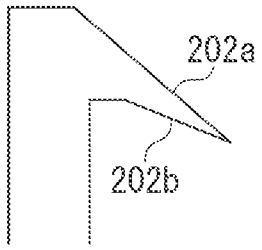
FIGS. 8A to 8C each illustrate an example of an end portion of an arm.
Figure 8B:
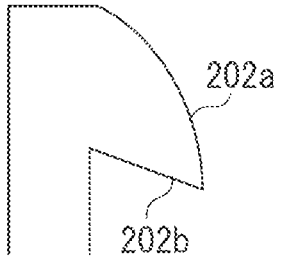
Figure 8C:
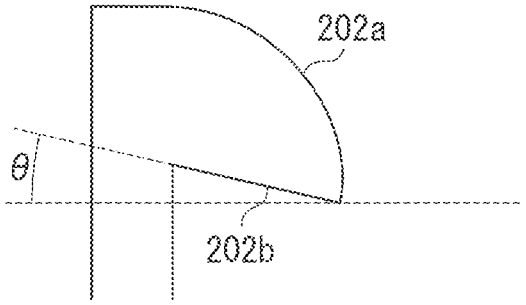

An end portion of the arm 202 is desirably in a shape of a sickle or may have a hollow structure as illustrated in FIG. 5. Further, even if the end portion of the arm 202 has a filled structure, it is effective as long as the second surface 202*b* of the arm 202 is inclined with respect to the surface on which the apparatus is installed when the cover 201 is in the closed state. For example, the second surfaces 202*b* illustrated in FIGS. 8A to 8C are effective. An inclination angle θ of the second surface 202*b* is desirable in a range from 5° to 45°, and a range from 10° to 25° is more desirable. In addition, it is desirable that the first surface 202*a* is a curved surface as illustrated in FIG. 8C to allow the rib 201*b* to frictionally slide on the first surface 202*a*.

As described above, according to the exemplary embodiment of the present invention, an end portion of an arm for applying a force to a rib of a cover and an urging member (second member) for stably applying a force to a storage medium access unit (first member) are integrally used as the arm. With this configuration, there is no need to separately provide a pushing unit to stabilize the contact point of the storage medium and the apparatus body. Thus, an increase in the number of parts can be suppressed and, depending on the design, the number of parts can be reduced.

[State in which Cover is Closed (Closed State)]

Figure 6:
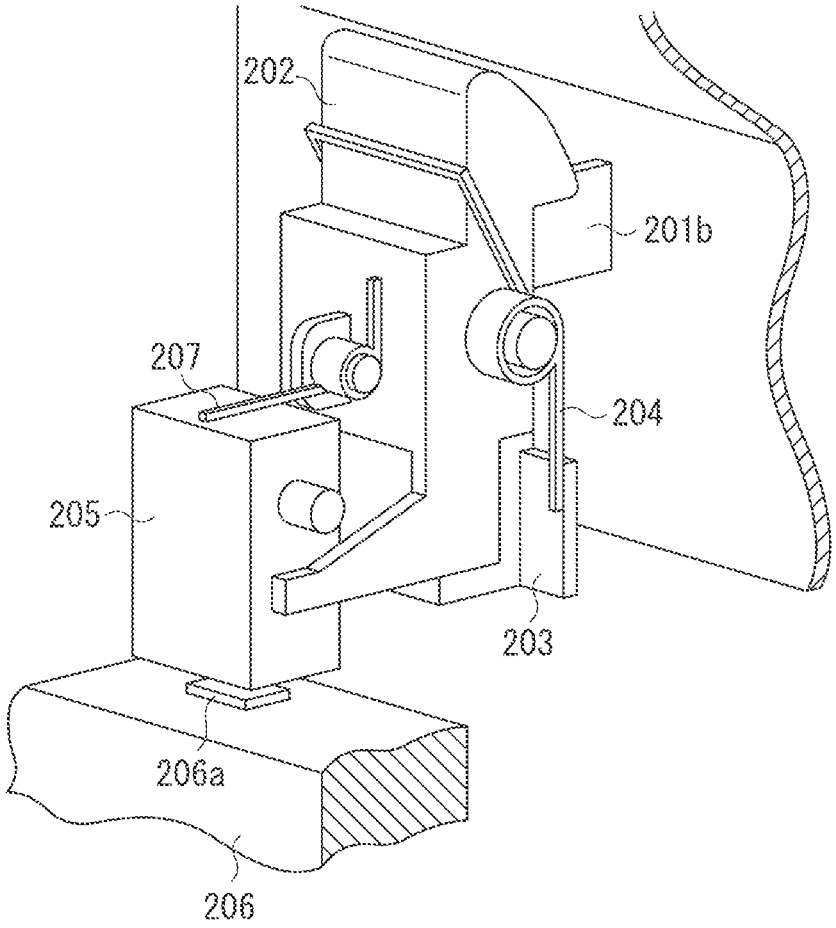
FIG. 6 is a perspective view illustrating an example of a schematic structure of an exemplary embodiment.

FIGS. 4 and 6 each illustrate a state in which the cover 201 which is freely rotatably fixed to the apparatus body 90 is closed (i.e., a closed state).

The rib 201*b* formed on the cover 201 remains stationary by receiving a moment A2 after having rotated the arm 202 about the rotation fulcrum 203*a* of the base 203 fixed to the apparatus body 90 in the opposite direction to the moment A2. At this time, the contact point pushing torsion spring (second member) 207 attached to the arm 202 pushes the storage medium access unit (first member) 205 with a force B to apply contact pressure to the contact point where the storage medium access unit 205 and the storage medium 206*a* are in contact with each other.

[3. Abutment Position of Rib and Arm]

Figure 7:
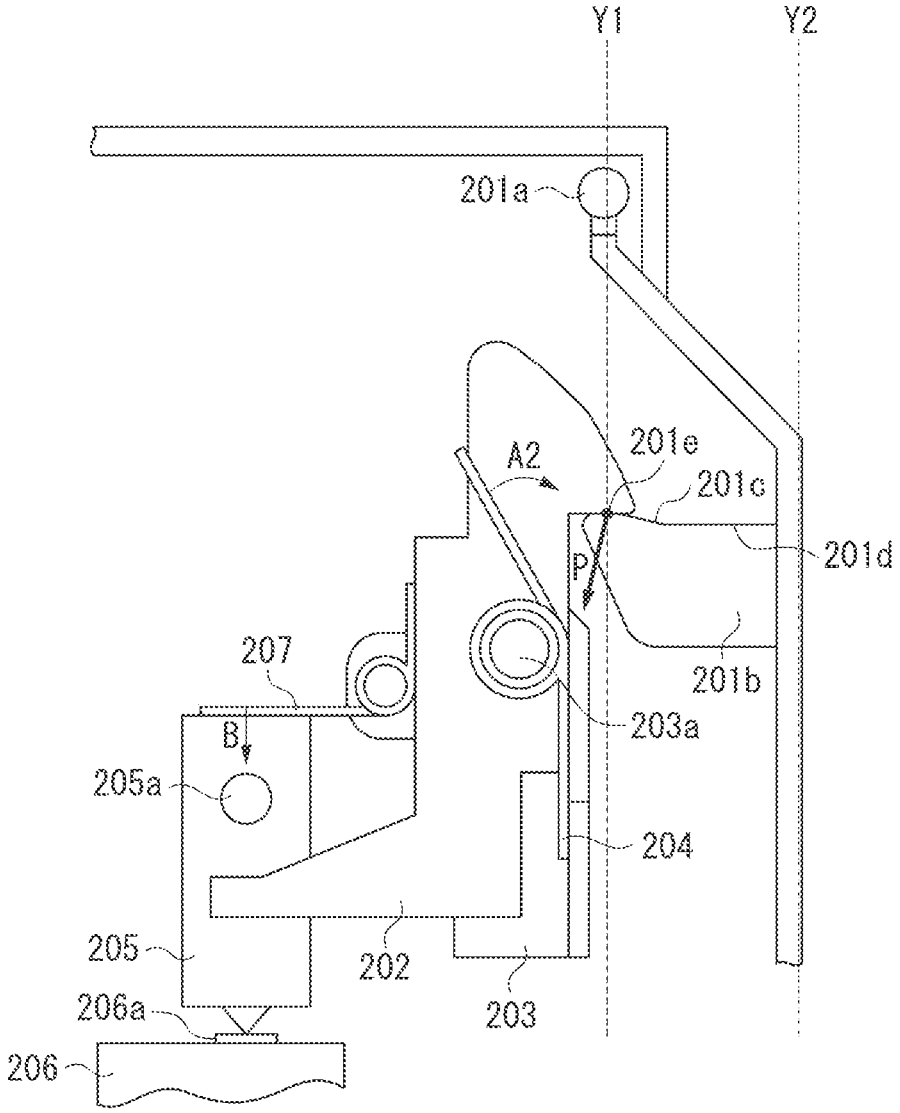
FIG. 7 is a schematic diagram illustrating a position of an abutment portion of a rib and an arm.

As illustrated in FIG. 7, the rib 201*b* abuts the arm 202 at the abutment portion 201*e*. According to the present exemplary embodiment, the abutment portion 201*e* is positioned at the downstream side of the rotation fulcrum 201*a* of the cover 201 in the direction of gravity (Y1). To further stabilize the closing position of the cover 201, the rotation fulcrum 201*a* may be provided at a position closer to a position Y1 than to a position Y2, and the rib 201*b* can be applied a force more effectively.

When the gradient of the vector of the force P is inclined toward the inside of the apparatus from the direction of gravity, a force is effectively applied to the rib 201*b*. Thus, for example, the inclination of the intersecting surface 201*c* of the rib 201*b* may be increased. Although it can be effective to incline the intersecting surface 201*c* at an angle θ indicated in FIG. 5 of 2° or 3° with respect to the horizontal surface 201*d*, it is desirable to incline the intersecting surface 201*c* at 5° to 45°, more desirably 10° to 25°. Alternatively, the shape of the sickle of the arm may be modified to further incline the vector of the force P.

[4. Other Applications, etc.]

According to the above-described exemplary embodiment, the arm includes the urging member (second member) provided to apply a force to the storage medium access unit. However, a target to be urged according to exemplary embodiments of the present invention is not limited to the storage medium access unit. For example, an urging member may include a mechanism for transmitting and receiving electric signals to and from an apparatus body, so that the urging member can directly apply a force to a storage medium to establish an electrical connection. Further, an urging member may apply a force to a laser shutter provided to avoid unnecessary exposure so that laser light can reach an area to be exposed. Furthermore, an urging member may apply a force to a door switch.

The present invention can provide an apparatus with a movably provided cover that uses parts integrally to avoid an increase in the number of parts, compared with conventional apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-196871 filed Sep. 7, 2012 and No. 2013-131661 filed Jun. 24, 2013, which are hereby incorporated by reference herein in their entirety.

What is claimed is:

1. An apparatus comprising:

a cover including a protrusion; and an abutment unit, capable of abutting the protrusion, including (i) a second member for applying a force to a first member of an image forming apparatus and (ii) a lifting portion for lifting the first member, wherein the abutment unit includes a first surface which abuts the protrusion in a case where the cover is shifted from an opened state and a second surface which abuts the protrusion in a case where the cover is shifted to the closed state after having abutted the first surface, and wherein the first and second surfaces are on one of end portions of the abutment unit, the lifting portion is on the other end portion, and a rotational fulcrum of the abutment unit is arranged between (i) the first and second surfaces and (ii) the lifting portion.

2. The apparatus of claim 1, wherein the protrusion, the abutment unit and the first member are arranged toward an inside of the apparatus in this order.

3. The apparatus according to claim 1, wherein the abutment unit is sandwiched between the protrusion and the first member.

4. The apparatus according to claim 1, wherein the protrusion includes an intersecting surface that intersects with the second surface of the abutment unit when the cover is in the closed state, and the intersecting surface abuts the second surface of the abutment unit when the cover is in the closed state, so that the protrusion is applied a force from the rotational force of the abutment unit.

5. The apparatus according to claim 1, wherein one end portion of the abutment unit includes the first surface on which the protrusion frictionally slides while abutting thereon and the second surface on which the protrusion abuts after having frictionally slid on the first surface.

6. The apparatus according to claim 1, wherein the first member is any one of a storage medium access unit configured to access a storage medium, a laser shutter, a door switch, and a storage medium.

7. The apparatus according to claim 1, wherein the abutment unit includes a lifting end portion for lifting the first member when the cover is shifted from the closed state to the opened state.

8. The apparatus according to claim 1, wherein the cover has a convex shape toward outside the apparatus.

9. The apparatus according to claim 1, wherein a process cartridge including an image bearing member is attachable to and detachable from the apparatus, and the storage medium is provided to the process cartridge.

10. The apparatus according to claim 1, wherein a cleaning device is attachable to and detachable from the apparatus, and the storage medium is provided to the cleaning device.

11. The apparatus according to claim 1, wherein a developing device including a developer bearing member is attachable to and detachable from the apparatus, and the storage medium is provided to the developing device.

12. An image forming apparatus capable of forming an image on a recording medium with a developer with use of an apparatus according to claim 1.

13. The apparatus according to claim 1, wherein the second member contacts with the first member when the cover is in the closed state.

14. The apparatus according to claim 1, wherein the second member pushes the first member when the cover is in the closed state.

15. The apparatus according to claim 1, wherein the abutment unit is sandwiched between the protrusion and the first member.

16. The apparatus according to claim 1, wherein the protrusion, the abutment unit and the first member are arranged toward an inside of the apparatus in this order.

17. The apparatus according to claim 1, wherein the protrusion has an inclined surface.

18. The apparatus according to claim 17, wherein the inclined surface is inclined at 5° to 45°.

19. The apparatus according to claim 17, wherein the protrusion is applied an inclined force, which is inclined toward an inside of the apparatus, from a rotational force of the abutment unit when the inclined surface abuts the second surface, and the second member of the abutment unit applies a force to the first member when the cover is in the closed state.

* * * * *